US009821175B2

(12) United States Patent
Dapkins, Jr. et al.

(10) Patent No.: US 9,821,175 B2
(45) **Date of Patent: *Nov. 21, 2017**

(54) DYNAMIC ENTRY CLAW DEVICE

(75) Inventors: John A. Dapkins, Jr., Bloomsbury, NJ (US); Nicholas Klementowicz, III, Hillsborough, NJ (US); Kenneth P. Glynn, Flemington, NJ (US)

(73) Assignee: Jersey Tactical Corp., Hillsborough, NJ (US)

( * ) Notice: Subject to any disclaimer, the term of this patent is extended or adjusted under 35 U.S.C. 154(b) by 252 days.

This patent is subject to a terminal disclaimer.

(21) Appl. No.: 12/455,172

(22) Filed: May 29, 2009

(65) Prior Publication Data

US 2010/0299843 A1 Dec. 2, 2010

(51) Int. Cl.
*A62B 3/00* (2006.01)
*B25F 1/00* (2006.01)

(52) U.S. Cl.
CPC ..... *A62B 3/005* (2013.01); *B25F 1/00* (2013.01)

(58) Field of Classification Search
CPC .. A62B 3/005; A62B 3/00; B25F 1/00; B25C 11/00; B66F 15/00
USPC ..... 7/138, 142–147, 166, 169, 170; 30/308.1, 299, 304; 29/254, 275; 173/90, 128; 81/20; 254/25, 26 R, 21, 254/131.5, 131
See application file for complete search history.

(56) References Cited

U.S. PATENT DOCUMENTS

| | | | | | |
|---|---|---|---|---|---|
| 63,747 | A | * | 4/1867 | Connolly | 72/477 |
| 2,498,069 | A | * | 2/1950 | Clayden | 254/131.5 |
| 3,219,316 | A | | 11/1965 | Fried | |
| 3,710,407 | A | | 1/1973 | Reid | |
| 3,921,288 | A | | 11/1975 | Clemens, Jr. | |
| 4,200,130 | A | * | 4/1980 | Reamy | 81/20 |
| 4,681,171 | A | | 7/1987 | Kee et al. | |
| 4,785,488 | A | | 11/1988 | Schellas | |
| 5,088,174 | A | | 2/1992 | Hull et al. | |
| 5,177,850 | A | | 1/1993 | Hull et al. | |
| 5,428,853 | A | | 7/1995 | Menke et al. | |
| D392,867 | S | * | 3/1998 | Gracy et al. | D8/89 |
| 5,836,222 | A | * | 11/1998 | Harpell | E04D 15/003 254/131.5 |
| 6,035,946 | A | | 3/2000 | Studley et al. | |
| 6,113,074 | A | | 9/2000 | Foley et al. | |
| 6,389,870 | B1 | * | 5/2002 | Vigil | A62B 3/005 72/392 |
| 6,671,913 | B2 | | 1/2004 | Wozniak | |
| D569,211 | S | * | 5/2008 | Peddie | D8/88 |

(Continued)

*Primary Examiner* — Robert Scruggs
(74) *Attorney, Agent, or Firm* — Ernest D. Buff & Assoc., LLC; Ernest D. Buff, Esq.; Harry Anagnost

(57) ABSTRACT

A multifunctional tactical device for fire, police, military and other tactical invasive and protective actions includes: a) a claw head having a ram region and a claw region, the ram region having a top of a predetermined width and a bottom that has a predetermined width that is at least 30% wider than the top predetermined width, the claw head having a front with a flat ram area at the ram region, and having a back with a handle attachment, the claw region having a plurality of claws extending downwardly from the bottom of the ram region; b) an elongated handle member having a proximal end and a distal end and being connected to the claw head handle attachment at the distal end.

4 Claims, 12 Drawing Sheets

(56) References Cited

U.S. PATENT DOCUMENTS

| | | | | |
|---|---|---|---|---|
| 2002/0134971 | A1* | 9/2002 | Christensen | B66F 15/00 254/25 |
| 2005/0062026 | A1* | 3/2005 | Holcomb | 254/25 |
| 2006/0075572 | A1* | 4/2006 | Young | B25B 13/48 7/138 |
| 2009/0000097 | A1* | 1/2009 | Dapkins, Jr. | A62B 3/005 29/275 |
| 2009/0307847 | A1* | 12/2009 | Liou | B25F 1/00 7/166 |

* cited by examiner

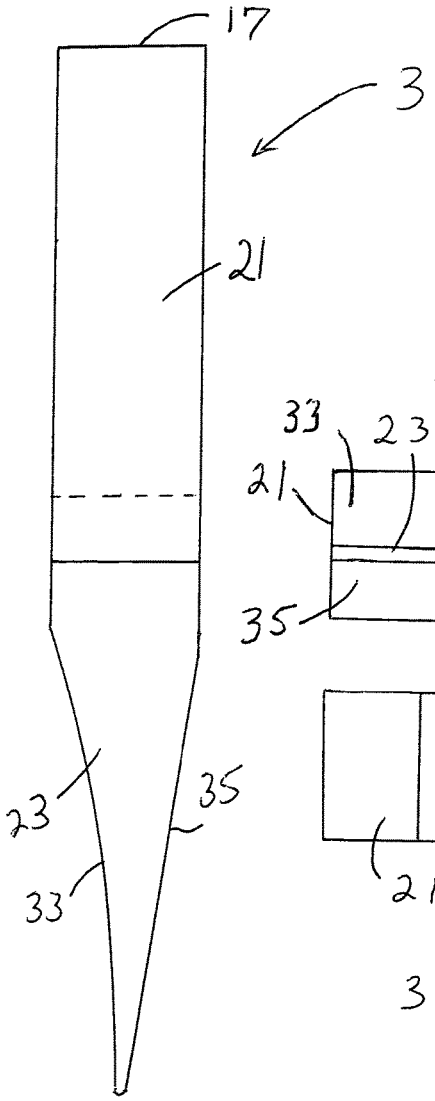
Figure 5
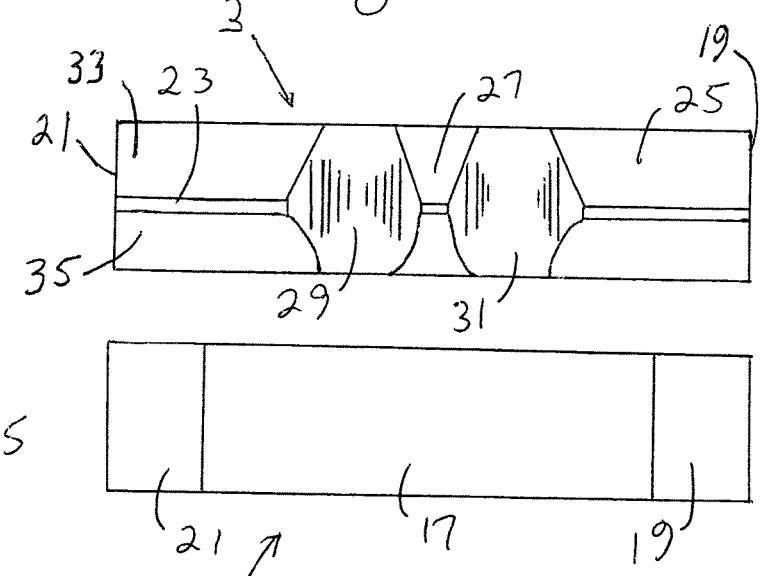
Figure 6
Figure4

DYNAMIC ENTRY CLAW DEVICE

BACKGROUND OF INVENTION a. Field of Invention

The invention relates generally to a multifunctional tactical device that is a dynamic entry claw device for serving military, law enforcement, fire and security personnel. The present invention device is a single unit that serves as an extra wide pry bar, a set of claws, a ram for forced entry, a padlock and shackle buster, a sledgehammer, a window rake, a fireman's tool and many other functions. It is one of the most diversified, most capable and most efficient tactical tool ever offered to serve the men and women who defend and protect us.

b. Description of Related Art

The following patents are representative of the state of the art of tactical devices:

U.S. Pat. No. 6,671,913 B2 to Wozniak describes a tool for military or police uses with removable interchangeable tool heads and handles. The handles of the tool assembly have connector assemblies at each end of the handle constructed of a cast nylon material impregnated with a dry lubricant and with a dimpled pin connector in the connector assemblies. Each tool head has a bore for receipt of the connector assembly and pin connector. The connector assemblies are constructed of a non-conductive, non-sparking material and the bores on the tool heads for receipt of the connector assemblies are made with close tolerances to provide for overall rigidity and strength of the tool assembly. The handles have a soft, non-conductive, shock absorbing outer covering. The pin connectors on the connector assemblies are oriented with the outer covering of the tool handles to facilitate ease of assembly of the tools in the dark of other adverse conditions.

U.S. Pat. No. 6,113,074 to Foley et al. describes a combination construction and wrecking tool for performing multiple operations such as hammering, picking, axing, pounding, prying and bashing. The tool has a shaft with a handle at the upper end which has a grip that is offset and which is rotatable. The head end has a slightly curved base with a notch at one end and a hammer face at the opposite end.

U.S. Pat. No. 6,035,946 to Studley et al. describes an improved forcible entry tool for opening locked or jammed doors by emergency personnel for the purpose of apprehending criminal suspects, gathering evidence, and preserving lives of people who become trapped by fire, earthquake, tornadoes, or by other circumstances beyond their control. The tool of the present invention comprises an elongated frame with a piercing pivot blade on the front end of the tool. The pivot blade is configured to pivot perpendicular to the frame upon penetration through a door, thereby enabling the tool operator to effectively pull back on the tool to break open an outwardly swinging door. A detachable ram head may be mounted over the front end of the frame for purposes of breaking through a door that swings inward (i.e. away from the tool operating personnel).

U.S. Pat. No. 5,428,853 to Menke et al. describes a fireman's personal hand tool, which is comprised of a spike member and a wrench member. Both members may be used in combination as a slide hammer with the spike member being hammered by the wrench member between objects to be pried apart. The wrench member may also be used to open or close valves and is configured to fit a variety of hydrant valve head shapes and sizes. Both the spike member and the wrench member have integral hose coupling jaws to engage in disengage hose couplings. The members are separable so that the jaws may be used independently or in combination. In addition, there are three different sizes of jaws to enable the tool to fit a greater variety of coupling sizes.

U.S. Pat. No. 5,177,850 to Hull et al. describes a forcible entry tool which enables law enforcement personnel such as SWAT teams or police or other persons such as firemen to breach a heavily fortified door or the like in a matter of seconds without the use of explosives. A ram is taught which is adjustable in weight to suit the needs of an individual and which may be inter-locked with another ram of the same structure in order to "gang" them and several can be locked together, forming a heavy, multi-manned battering ram.

U.S. Pat. No. 5,088,174 to Hull et al. describes a forcible entry tool which is disclosed which enables law enforcement personnel such as SWAT or police or other persons such as firemen to breach a heavily fortified door or the like in a matter of seconds without the use of explosives. A ram like device is taught which is normally operated by two persons which can penetrate through a steel re-enforced door by using a heavy-duty slide hammer with a leg support that is locked to the correct height for support when a pin is pulled. The apparatus also has a hook on one end which may be impaled in the door or hooked to any other object and the door or object removed outwardly.

U.S. Pat. No. 4,785,488 to Schellas describes an improved, versatile, lever bar which may be used as a crowbar, prybar, sledge hammer, pickaxe, wedge, etc. The lever bar has a long handle with a thick base plate chamfered at one end secured perpendicular to the axis of the handle at one end thereof. A thick foot plate has a sharp end from which diverge edges defining an acute angle for entering under or behind boards to be pried. A massive, flat, triangular or trapezoidal anvil plate is secured to the base plate and handle. The base plate and anvil plate can serve as a hammer heads while the tool is used as a sledge hammer. The base plate and foot plate can serve as splitting wedges and as heads of a pickaxe.

U.S. Pat. No. 4,681,171 to Kee et al. describes a battering ram operable by one person for battering objects that has in one arrangement a concrete-filled tube with first and second ends with an epoxy resin contact face at the first end, a first handle located proximate to the center of gravity of the body, and a second handle located at the second end.

U.S. Pat. No. 3,921,288 to Clemens, Jr. describes a wrecking tool for piercing wall and ceiling surfaces and for enabling easy removal of sections thereof. The tool performs a number of functions, including piercing, chipping, prying, gouging, tearing, and also can be used as a lever for removing trim and for forcing open doors and windows.

U.S. Pat. No. 3,710,407 to Reid describes a combination tool for opening wrecked vehicles and the like comprising a first elongated tool member having first and second ends with a bore extending thereinto from one end thereof. A second elongated tool member is selectively slidably received in the bore of the first tool member and has a tool head portion at its outer end. The tool head portion includes a pry bar means, cutting means and spike means mounted thereon. The first tool member is selectively slidably movable with respect to the second tool member to effectively extend the length of the tool to provide additional leverage for the tool head portion when the same is being used to open a wrecked vehicle. The first tool member includes a hammer head at one end thereof which may be used to strike the tool head portion when the tool members are separated to create additional impact force to the tool head portion. The first tool member may also be struck against the second tool member by slidably moving the same with respect to each other to aid the cutting means in penetrating materials.

U.S. Pat. No. 3,219,316 to E. Fried describes a multipurpose forcible entry tool for use in the fire fighting, rescue work, and related emergencies. The tool has two working units which are adjustably secured together for use as one unit, and which also may be separated for independent use. When the units are separated, they may be used in a cooperative manner. A first working unit comprises an elongated tubular handle with a head mounted on one end thereof. This head has a chopping blade and a pike extending from opposite sides thereof. A second working unit comprises an elongated handle with a tapered head or wedge mounted thereon. The handle of the second unit is telescopeable within the tubular handle of the first unit opposite the head thereof engaging the head of the second unit. A manually releasable latch device secures the two handles of the second unit in fully telescoped position.

Notwithstanding the prior art, the present invention is neither taught nor rendered obvious thereby.

SUMMARY OF INVENTION

The present invention relates to a multifunctional dynamic entry device for fire, police, military and other tactical invasive and protective actions. The present invention device includes: a) a claw head having a ram region and a claw region, the ram region having a top of a predetermined width and a bottom that has a predetermined width that is at least 30% wider than the top predetermined width, the claw head having a front with a flat ram area at the ram region, and having a back with a handle attachment means, the claw region having a plurality of claws extending downwardly from the bottom of the ram region; b) an elongated handle member having a proximal end and a distal end and being connected to the claw head at the distal end.

In some preferred embodiments of the present invention multifunctional dynamic entry device for fire, police, military and other tactical invasive and protective actions, the plurality of claws taper downwardly from the flat ram area.

In some preferred embodiments of the present invention multifunctional dynamic entry device for fire, police, military and other tactical invasive and protective actions, the plurality of claws has a total external width of at least three inches.

In some preferred embodiments of the present invention multifunctional dynamic entry device for fire, police, military and other tactical invasive and protective actions, the plurality of claws includes at least three claws with two outer claws and at least one central claw.

In some preferred embodiments of the present invention multifunctional dynamic entry device for fire, police, military and other tactical invasive and protective actions in which there are at least three claws, the two outer claws are flat pry bar claws and the at least one central claw is a tapered shackle busting spike claw. In some of these preferred embodiments of the present invention, each of the flat pry bar claws includes a tapered cutting edge.

In some preferred embodiments of the present invention multifunctional dynamic entry device for fire, police, military and other tactical invasive and protective actions, one of the claw head and the handle includes a hydrant wrench.

In some preferred embodiments of the present invention multifunctional dynamic entry device for fire, police, military and other tactical invasive and protective actions, one of the claw head and the handle includes a utilities key wrench.

In some preferred embodiments of the present invention multifunctional dynamic entry device for fire, police, military and other tactical invasive and protective actions, the plurality of claws includes at least two claws having a tapered space therebetween for placement under objects for pull and lift actions.

In some preferred embodiments of the present invention multifunctional dynamic entry device for fire, police, military and other tactical invasive and protective actions, the ram region has a front view shape of the top and sides of a trapezoid.

In some other preferred embodiments of the present invention multifunctional dynamic entry device for fire, police, military and other tactical invasive and protective actions, the present invention includes: a) a claw head having a ram region and a claw region, the ram region having a top of a predetermined width and a bottom that has a predetermined width that is at least 30% wider than the top predetermined width, the claw head having a front with a flat ram area at the ram region, and having a back with a handle attachment means, the handle attachment means including at least one protrusion extending from the claw head back for attachment of an elongated handle, the claw region having a plurality of claws extending downwardly from the bottom of the ram region; b) an elongated handle member having a proximal end and a distal end and being connected to the claw head at the distal end.

In some preferred embodiments of the present invention multifunctional dynamic entry device for fire, police, military and other tactical invasive and protective actions of paragraph [00024], the plurality of claws taper downwardly from the flat ram area.

In some preferred embodiments of the present invention multifunctional dynamic entry device for fire, police, military and other tactical invasive and protective actions of paragraph [00024], the plurality of claws has a total external width of at least three inches.

In some preferred embodiments of the present invention multifunctional dynamic entry device for fire, police, military and other tactical invasive and protective actions of paragraph [00024], the plurality of claws includes at least three claws with two outer claws and at least one central claw. In some of these preferred embodiments of the present invention, the two outer claws are flat pry bar claws and the at least one central claw is a tapered shackle busting spike claw. In some of these preferred embodiments of the present invention, each of the flat pry bar claws includes a tapered cutting edge.

In some preferred embodiments of the present invention multifunctional dynamic entry device for fire, police, military and other tactical invasive and protective actions of paragraph [00024], one of the claw head and the handle includes a hydrant wrench.

In some preferred embodiments of the present invention multifunctional dynamic entry device for fire, police, military and other tactical invasive and protective actions of paragraph [00024], one of the claw head and the handle includes a utilities key wrench.

In some preferred embodiments of the present invention multifunctional dynamic entry device for fire, police, military and other tactical invasive and protective actions of paragraph [00024], the plurality of claws includes at least two claws having a tapered space therebetween for placement under objects for pull and lift actions.

In some preferred embodiments of the present invention multifunctional dynamic entry device for fire, police, military and other tactical invasive and protective actions of paragraph [00024], the ram region has a front view shape of the top and sides of a trapezoid.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings:

FIG. 4, FIG. 5 and FIG. 6 illustrate side, bottom and top views of the claw head shown in FIG. 3;

DETAILED DESCRIPTION OF THE EMBODIMENTS

Figure 1:
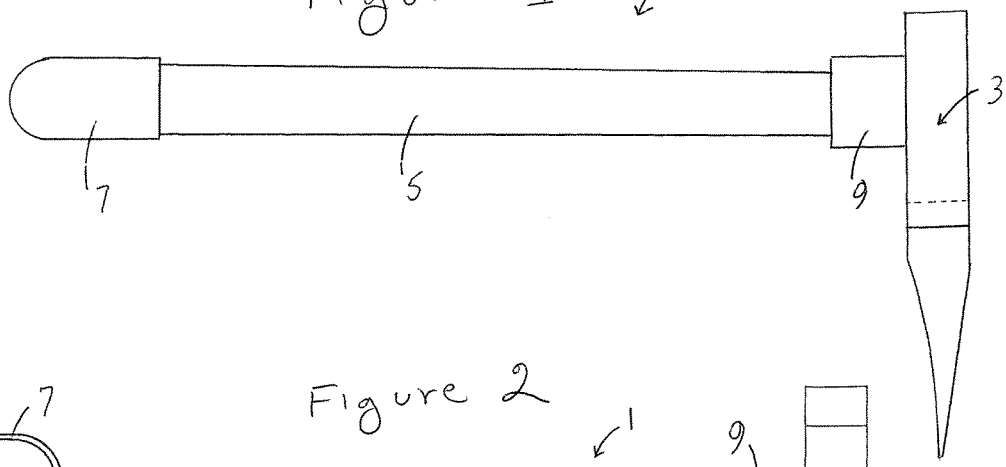
FIG. 1 is a side view of an embodiment of a present invention dynamic entry claw device and FIG. 2 is a top view thereof.

The present invention device may be used as a tool for professionals, and for emergency response personnel, demolition, military, fire, national and other law enforcement entities, including but not limited to police, sheriff, FBI, AFT, DEA, national guard, army, etc.

The present invention device has many diverse uses, including, but not limited to the following top examples:

(1.) Wide Pry Bar: With a plurality of claws and a preferred external claw width of at least three inches, this device will easily pry open almost any door.

(2.) Double Fork Pry Bar: The plurality of claws enables a user to break a door with both a knob lock and a separate dead bolt lock, in one action.

(3.) Ram: The front (distal) end has a large flat ram that easily busts through doors, shattered windows, etc and is more effective and more powerful than commercially popular ram devices.

(4.) Padlock Buster: The claws may grip and pull right through a padlock, i.e., rip it off its hasp or eyelets. Alternatively, the claws may be positioned with the spike claw inside the lock shackle and the device hammered or struck to shatter the lock.

(5.) Shackle Buster: The claws will grip and break right through shackles.

(6.) Hammer Claws: The claws may be used like a large set of hammer claws and pull large bolts and spikes and rip through wood, metal etc., by being slid under the item and either pulling or push-levering, like a hammer removing nails or ripping off a piece of wood.

(7.) Sledge Hammer: with the claws facing away from the target, the flat sledge hammer area may be used to smash upon the target or as a driver to drive in something large, e.g. emergency tent spikes.

(8.) Wall Buster: Given the size and weight of various embodiments, the present invention device will manually break wood, wood and drywall, and other construction material walls.

(9.) Diversion Tool: The present invention devices may be thrown through closed windows followed by tear gas and other diversionary devices.

(10.) Window Rake: The present invention devices are extremely efficient at raking out broken window glass wooden cross member, shades, etc. to create clear passage areas.

(11.) Fireman's Tool: The present invention devices are excellent tools for ripping apart burning debris, beams, walls, etc.

(12.) Shovel: The present invention devices are powerful manual shovels, using the claws for digging.

(13.) Wood Splitter: In a military environment or otherwise where firewood or fuel is needed, the present invention device is an excellent log splitter.

(14.) Weapon: In extreme circumstances, the present invention devices will outpower and destroy knife, machete, bayonet, or other weapon and will effectively take on attackers in seconds.

(15.) Emergency Door Brace: To protect a single soldier or law enforcement officer or to lock up an escape route, the present invention devices may be forced under a door to prevent opening from the opposite side.

(16.) Hinge Remover: For gates and large doors and even steel and other metal doors, the present invention devices are excellent hinge removal devices.

(17.) Chain Buster: The spike claws of present invention multifunctional tactical device may be inserted into a chain link and hammered so as to bust open the link and thereby break the chain. In this application, as in others above, a second present invention device may be inserted and used as the hammer.

The uses include many of the preferred uses, but many other uses are also viable with the present invention devices.

Figure 2:
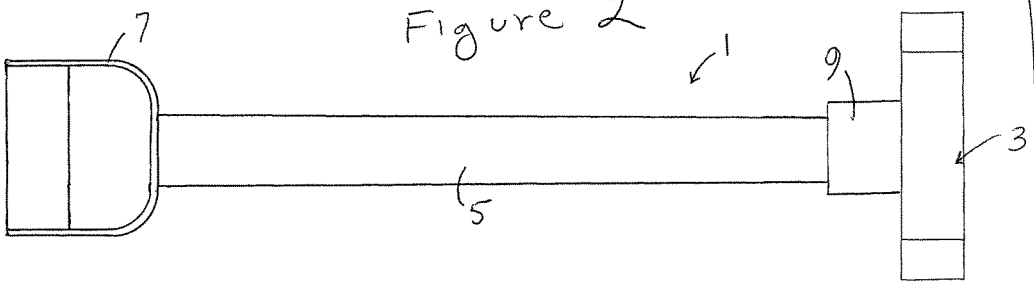

FIG. 1 is a side view of an embodiment of a present invention dynamic entry claw device 1 and FIG. 2 is a top view thereof. These figures are now discussed collectively wherein identical elements are identically numbered. Present invention dynamic entry device 1 includes a claw head 3 and a handle member 5. Handle member 5 has a proximal end with a handle grip 7 and a distal end inserted into and affixed in handle receiver 9. The handle receiver 9 could be circular, oval, rectangular, square or otherwise, and the cross section of the handle 5 could be the same or different. The handle 5 could be affixed in the receiver 9 by any know fastening mechanism, such as liquid polymer bonding (e.g., epoxy), bolting, riveting, welding, etc.

Figure 3:
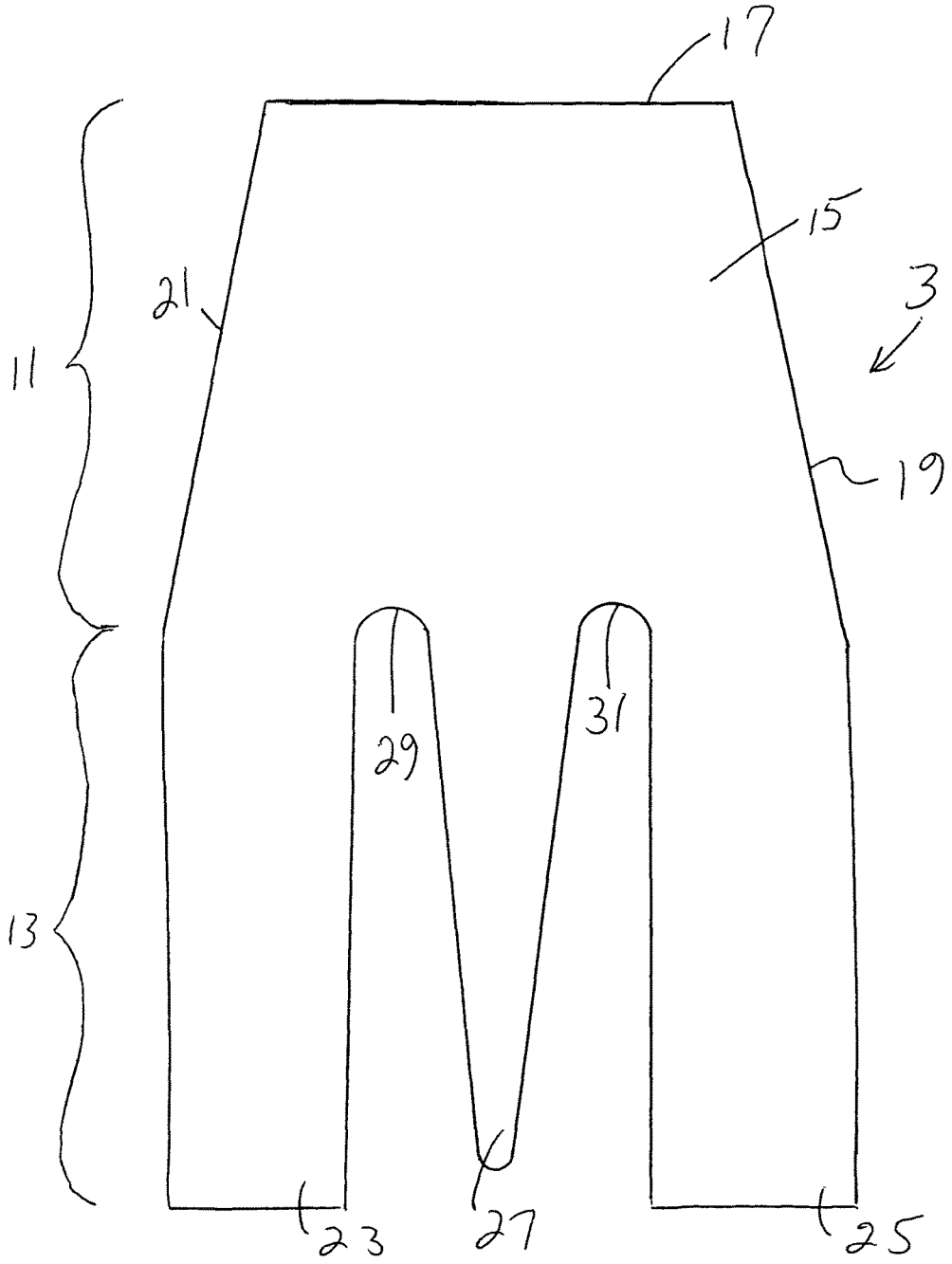
FIG. 3 is front view of the claw head of the present invention dynamic entry claw device shown in FIGS. 1 and 2 (the handle and handle attachment means are removed to show this component in more detail.

FIG. 3 shows front view of the claw head 3 of the present invention dynamic entry claw device 1 shown in FIGS. 1 and 2 (the handle 5 and handle attachment means 9 are removed to show this component in more detail. Claw head 3 has an upper section that is ram region 11, and a lower section that is claw region 13. Ram region 11 has a front ram area 15, a top 17, a bottom at the interface with claw region 13 (that transitions smoothly into claw region 13) and sides 19 and 21. These sides 19 and 21 are, in this embodiment, straight, and taper outwardly toward the bottom of ram region 11, so that the ram region bottom is at least 30% wider than top 17. Claw region 13 has three claws or tines, namely left pry bar claw 23, right pry bar claw 25, and central shackle buster claw 27. There are tapered, curved spaces 29 and 31 between the claws for placement under objects for pull and lift actions, such as removal of large spikes or nails, bolts, screws, etc.

FIG. 4, FIG. 5 and FIG. 6 illustrate side, bottom and top views of the claw head 3 shown in FIGS. 1, 2 and 3. In FIG. 4, there is shown side 21, top 17 and claw 23. Claw 23 has a curved tapered surface 33 and an opposite, flat tapered surface 35. These elements are also shown in bottom view FIG. 5, along with central shackle buster claw 27 and right claw 25. Tapered, curved spaces 29 and 31 between the claws, is also shown. FIG. 6 shows the top view of claw head 3 with top 17 and sides 19 and 21.

Figure 7:
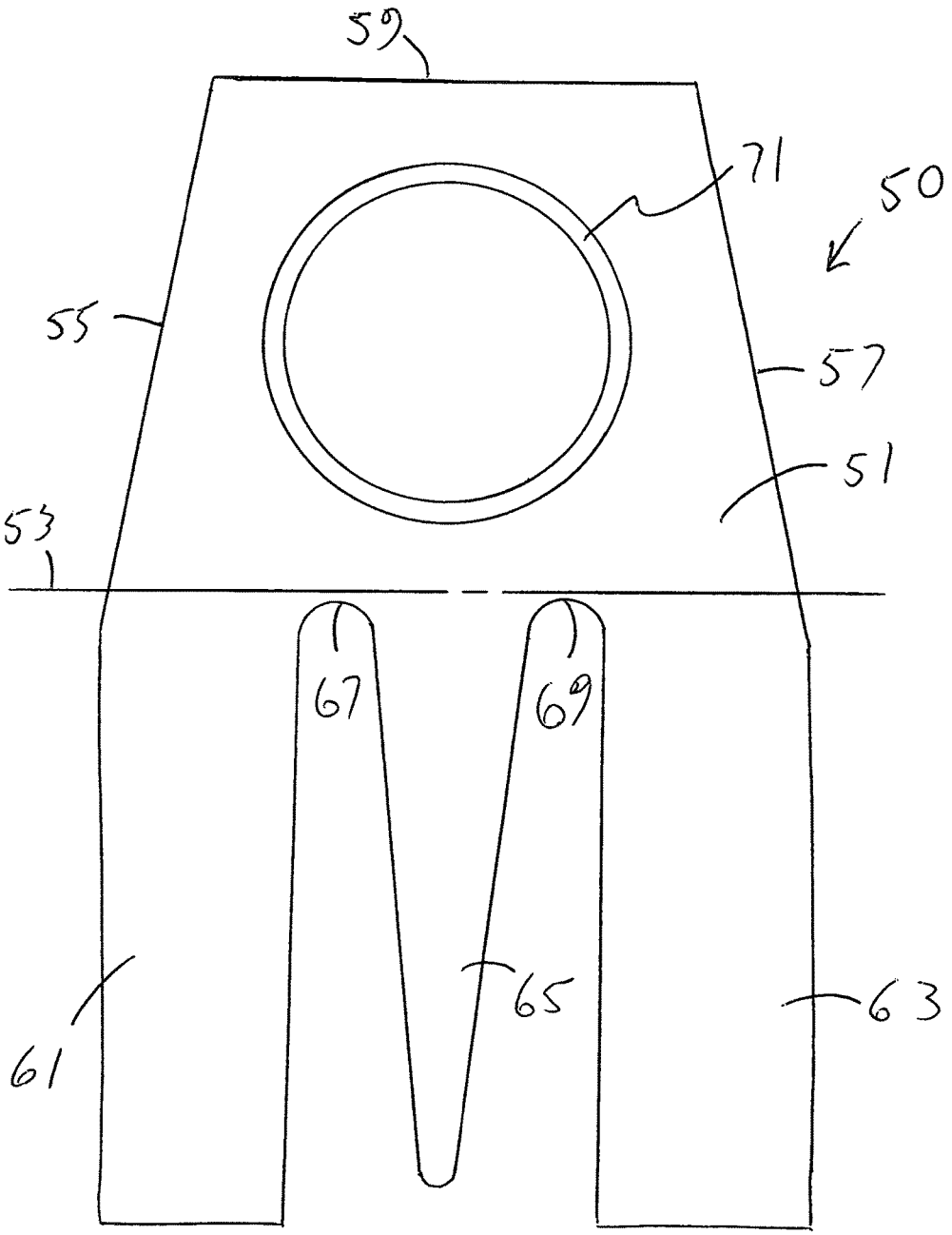
FIG. 7 is a back view of another alternative embodiment present invention claw head with a circular handle attachment receiver.

FIG. 7 is a back view of another alternative embodiment present invention claw head 50, with a circular handle attachment receiver 71. Claw head ram region 51 is above imaginary center line 53, and has straight tapered sides 55 and 57. Below center line 53 is the claw region with left claw 61, center spike claw 65 and right claw 63. Pry spaces 67 and 69 lie between the claws, as shown.

Figure 8:
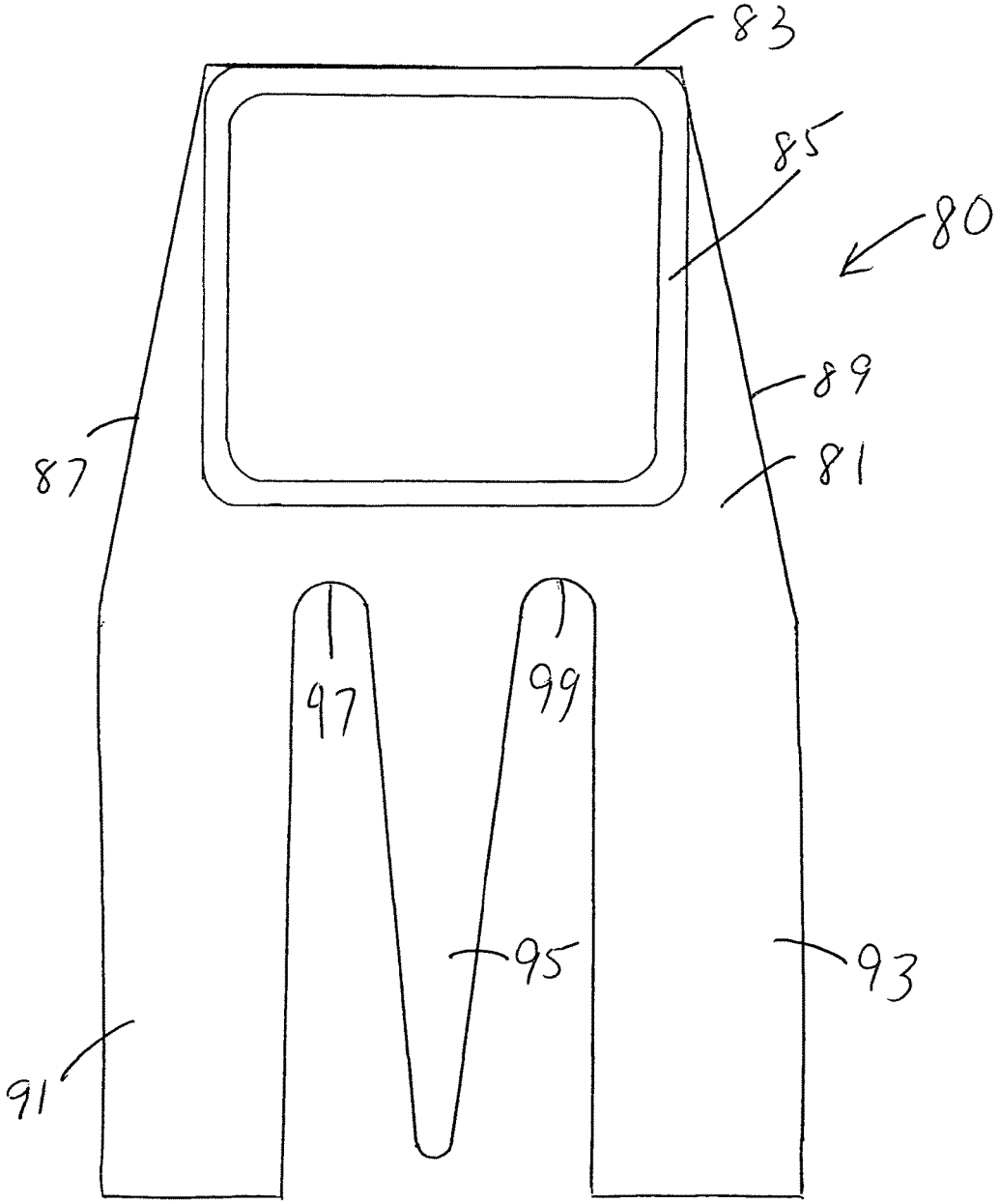
FIG. 8 is a back view of another alternative embodiment present invention claw head with a rectangular handle attachment receiver.

FIG. 8 is a back view of another alternative embodiment present invention claw head 80, with a rectangular handle attachment receiver 85. As mentioned, the handle receiver, when included, may have any shape to receive a handle and be backfilled with locking material, such as epoxy or other plastic, or molten metal. Alternatively, no receiver is needed, as in the case of an insert well and/or welding. Claw head 80 has a ram region 81 with outwardly tapered linear sides 87 and 89, and below ram region 81 is the claw region with left claw 91, center spike claw 95 and right claw 93. Pry spaces 97 and 99 lie between the claws, as shown.

Figure 9:
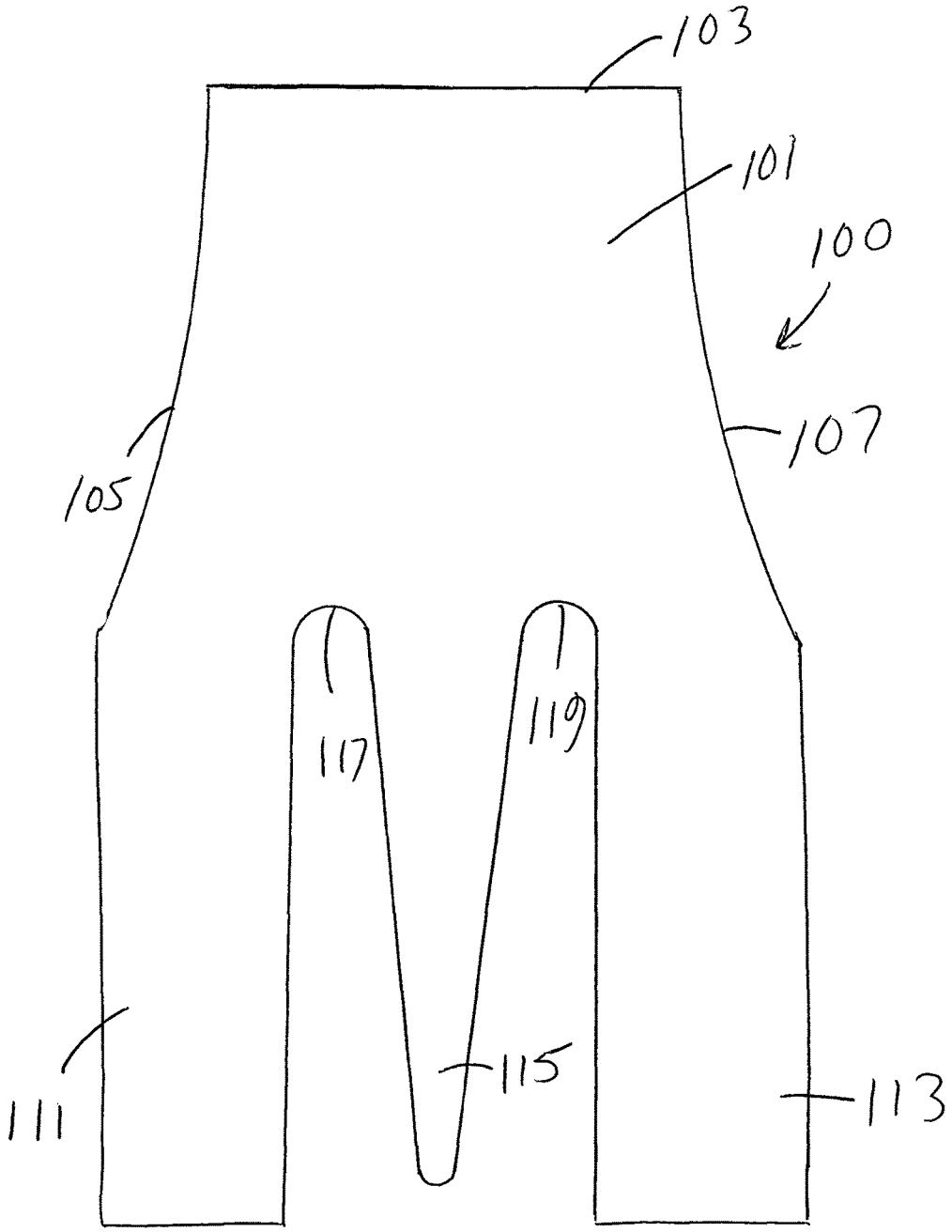
FIG. 9 is a front view of another alternative embodiment present invention claw head with arcuate claw head ram region sides.

FIG. 9 is a front view of another alternative embodiment present invention claw head 100. Claw region 101 has arcuate claw head ram region sides 105 and 107 that curve to form arcs that sweep outwardly and downwardly. Below ram region 101 is the claw region with left claw 111, center spike claw 115 and right claw 113. Pry spaces 117 and 119 lie between the claws, as shown.

Figure 10:
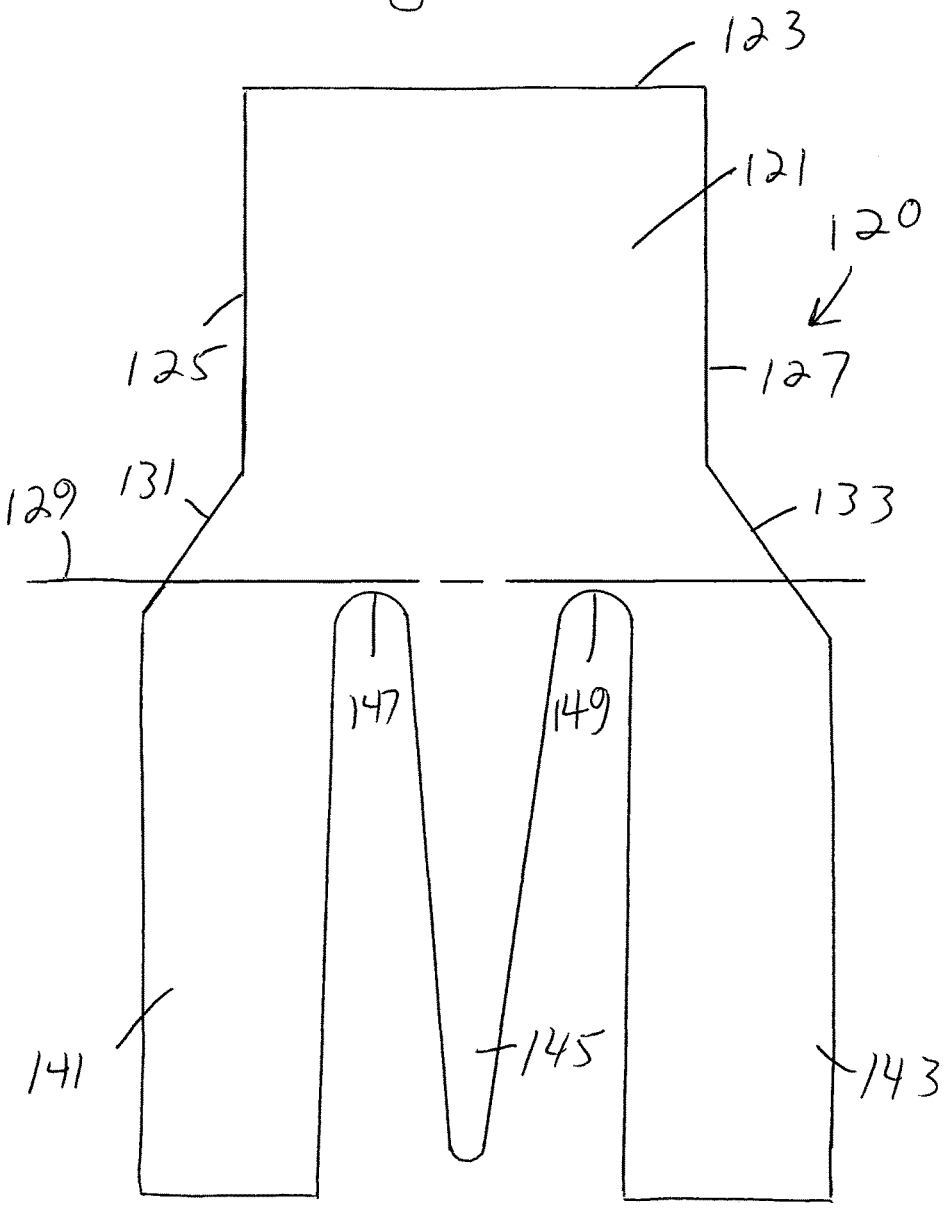
FIG. 10 is a front view of another alternative embodiment present invention claw head with a claw head ram region having parallel and then flared sides.

FIG. 10 is a front view of another alternative embodiment present invention claw head 120. It has a claw head ram region 121 having parallel sides 127 and 127 and then flared sides 131 and 133 below them, as shown. Below imaginary center line 129 is the claw region with left claw 141, center spike claw 145 and right claw 143. Pry spaces 147 and 149 lie between the claws, as shown.

Figure 11:
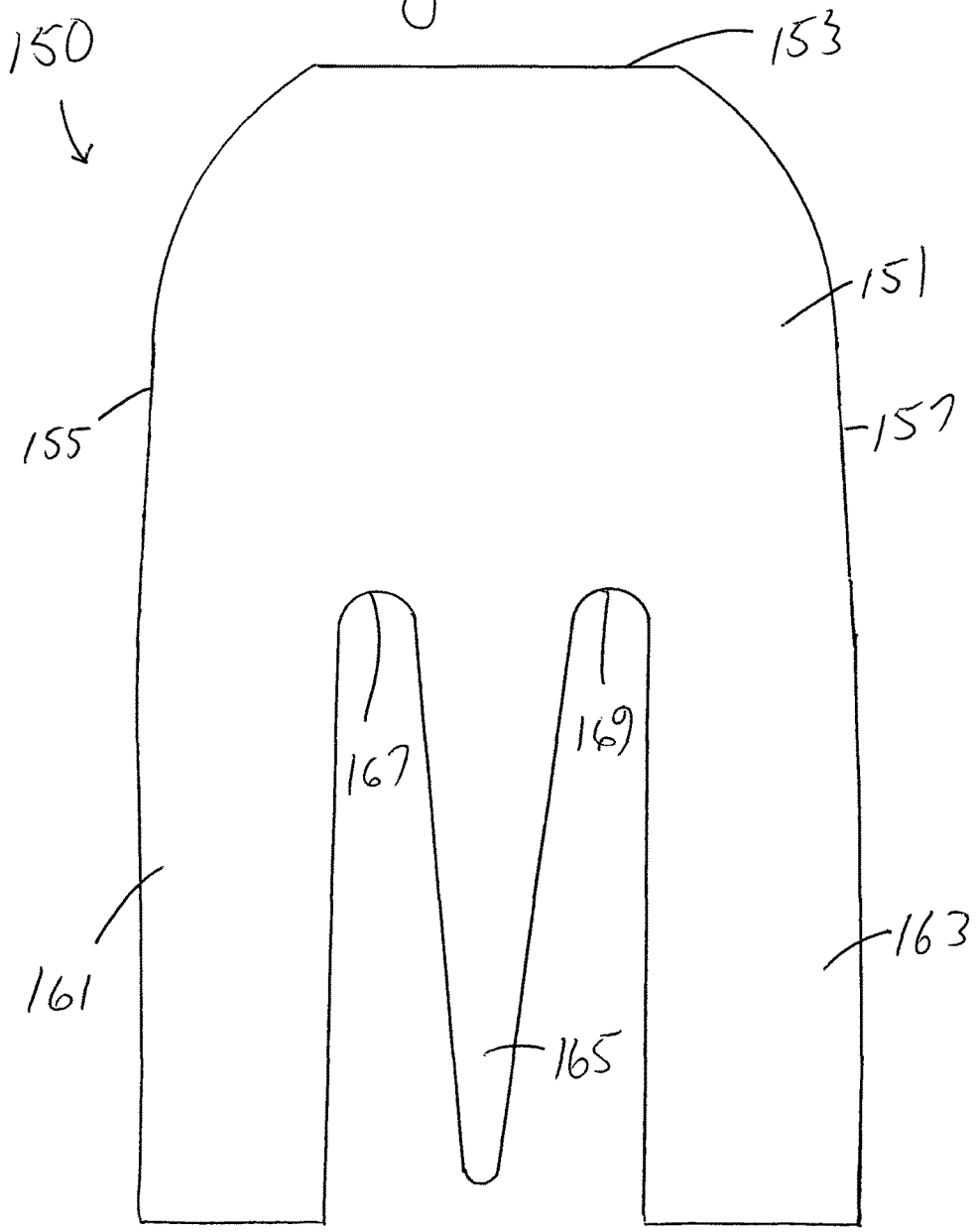
FIG. 11 is a front view of another alternative embodiment present invention claw head with a claw head ram region having rounded sides.

FIG. 11 is a front view of another alternative embodiment present invention claw head 150, with a claw head ram region 151 having rounded sides 155 and 157. Below ram region 151 is the claw region made up of left claw 161, center spike claw 165 and right claw 163. Pry spaces 167 and 169 lie between the claws, as shown.

Figure 12:
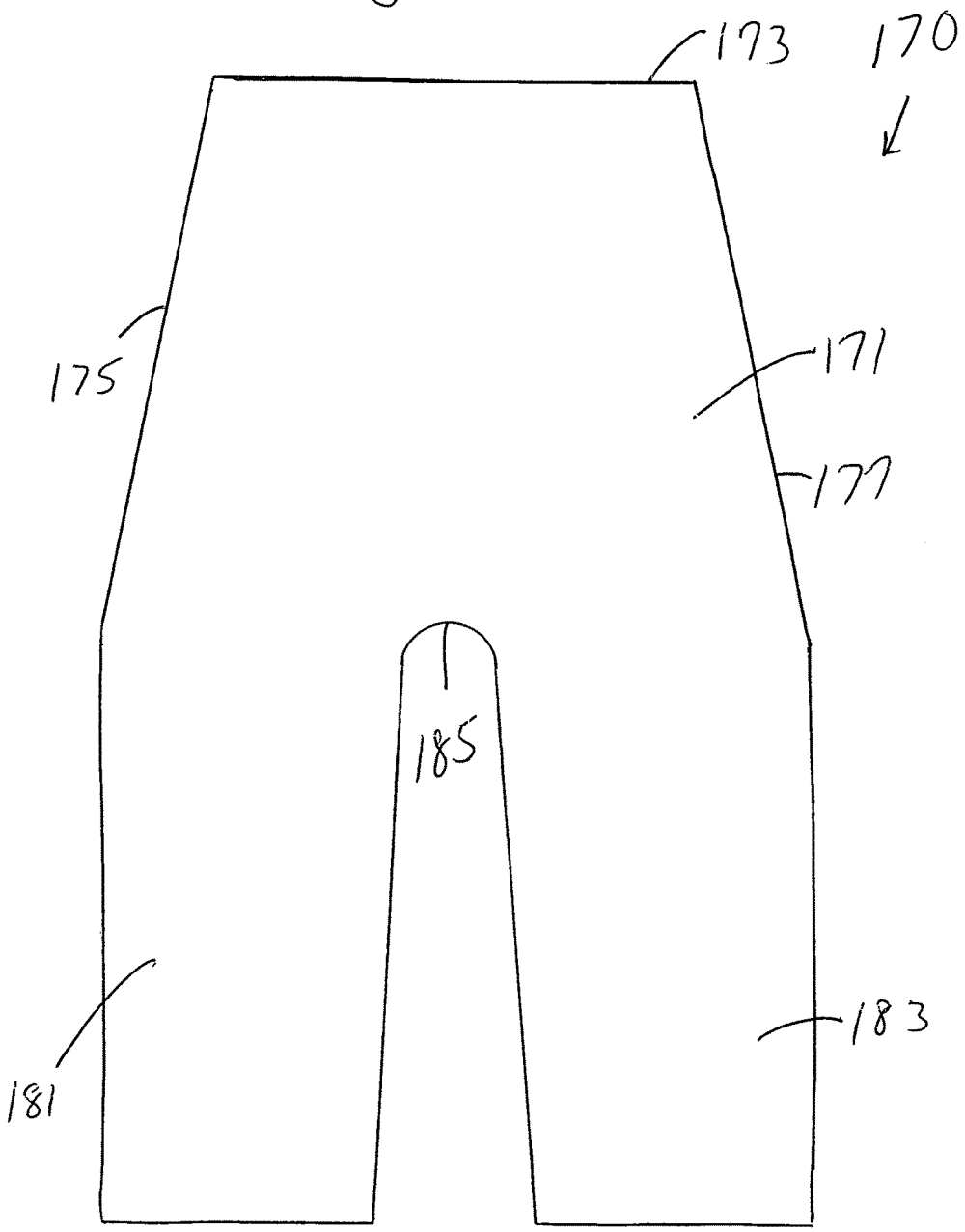
FIG. 12 is a front view of another alternative embodiment present invention claw head with a claw head claw region having two claws.

FIG. 12 is a front view of another alternative embodiment present invention claw head 170. Claw head 170 has a ram region 171 with outwardly tapering sides 175 and 177 and has a claw region having two claws 181 and 183 with pry space 185 therebetween.

Figure 13:
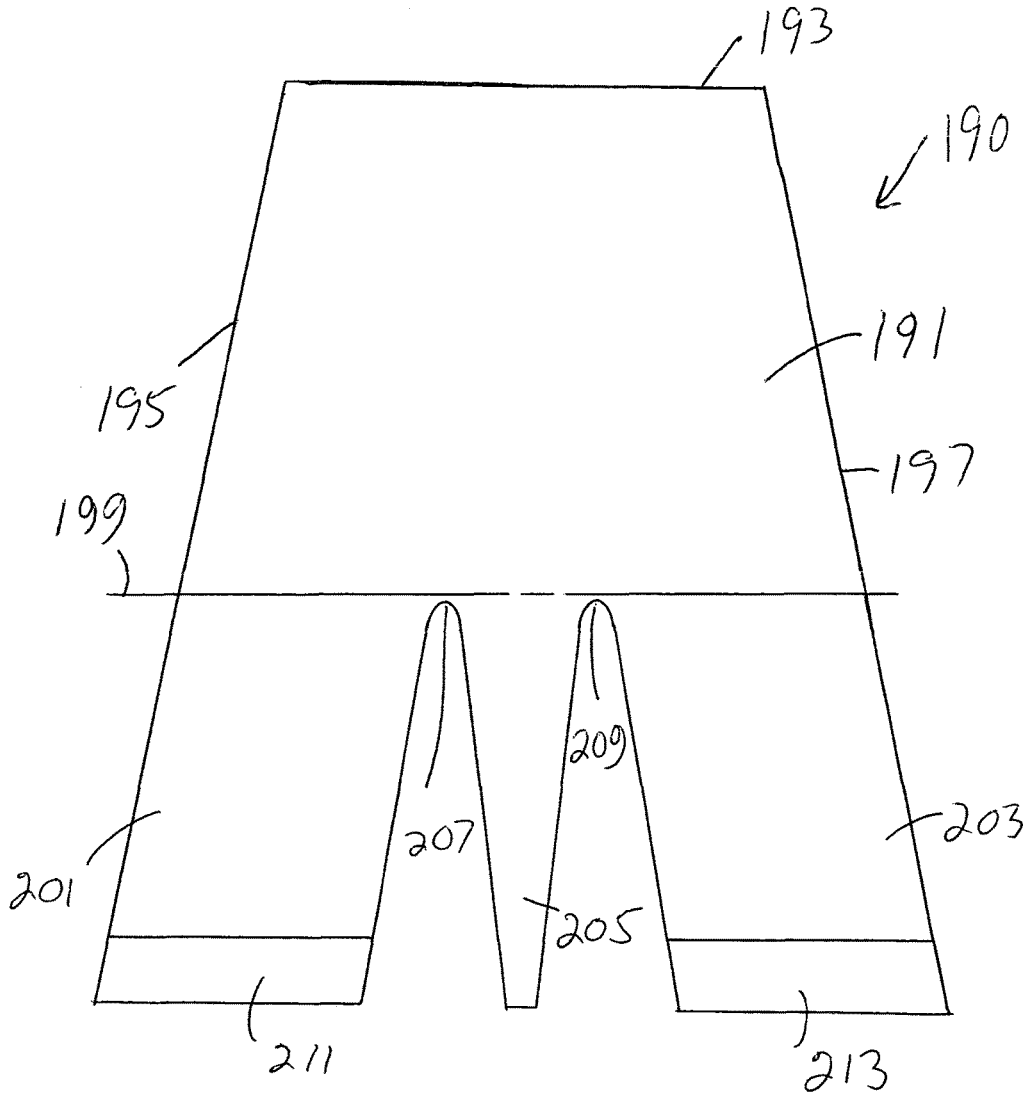
FIG. 13 is a front view of another alternative embodiment present invention claw head with claw head ram region having sides parallel to and in line with the claw region sides.

FIG. 13 is a front view of another alternative embodiment present invention claw head 190. Here, the claw head ram region 191 has sides 195 and 197 that are parallel to and in line with the claw region sides located below imaginary horizontal center line 199. The claw region shown includes left pry claw 201, right pry claw 203 and center spike claw 205, with pry spaces 207 and 209. In this embodiment, the pry claws 201 and 203 have sharpened ends 211 and 213, like an ax.

Figures 14, 15:
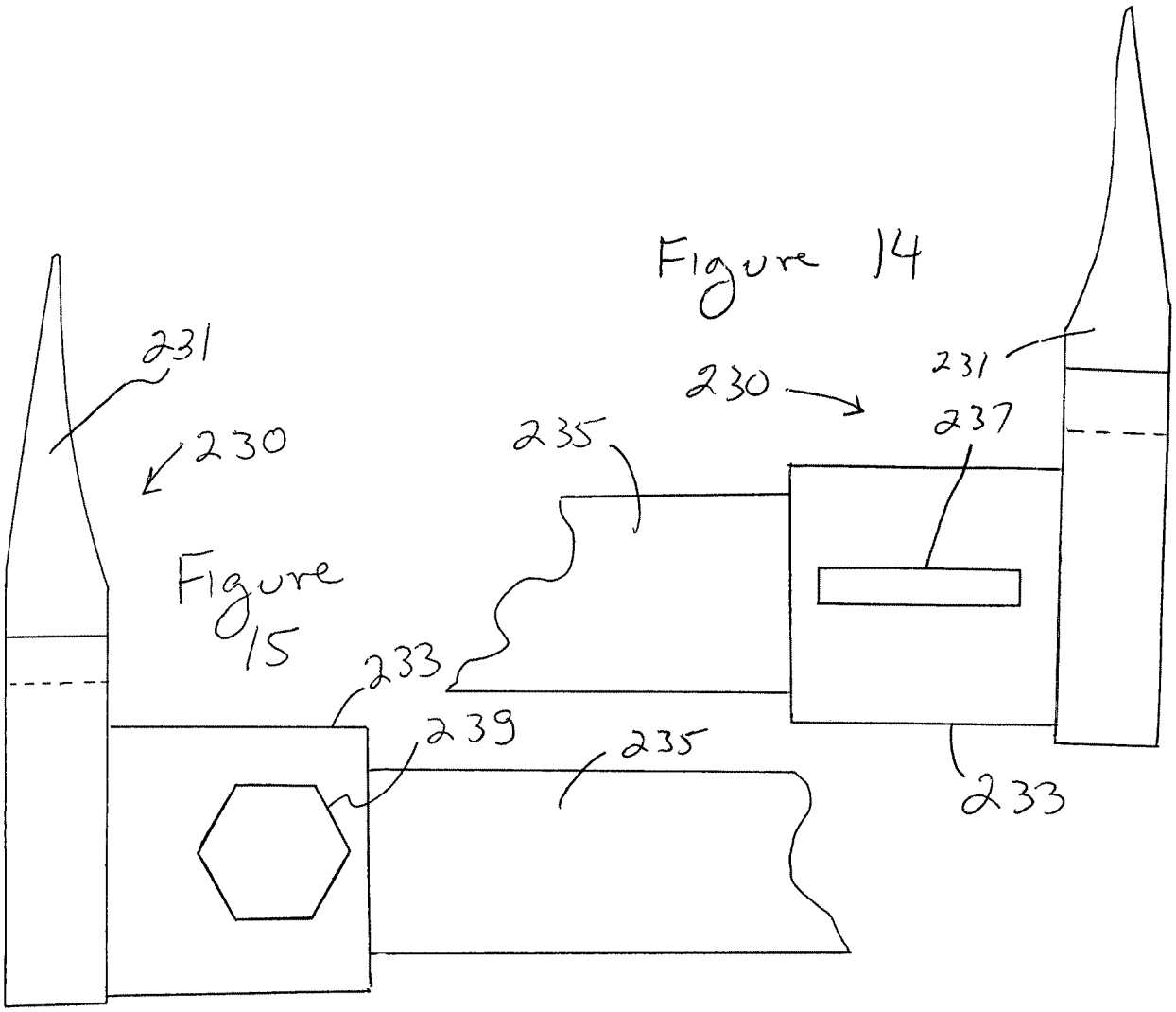
FIG. 14 is a cut side view of another alternative embodiment present invention device with a handle attachment receiver having a utilities key wrench thereon.
FIG. 15 is a cut side view of the alternative embodiment present invention device shown in FIG. 14, with a handle attachment receiver having a hydrant wrench thereon.

FIG. 14 is a cut right side view of another alternative embodiment present invention device 230 with a handle 235 connected to handle attachment receiver 233. Claw head 231 is attached to a handle attachment receiver 233, and handle attachment receiver 233 has a utilities key wrench 237 cut or otherwise formed thereon. This enables a user, such as a fireman, police officer, emergency personnel, military, etc, to use present invention device 230 to shut off gas or other utility with key wrench 237, as well as to use it for one or more of the diverse other uses shown above. FIG. 15 is a cut left side view of the present invention device 230 shown in FIG. 14 with identical parts identically numbered. On this side of handle attachment receiver 233 is a hydrant wrench 239 that may be used to open and close fire hydrants.

Figure 16:
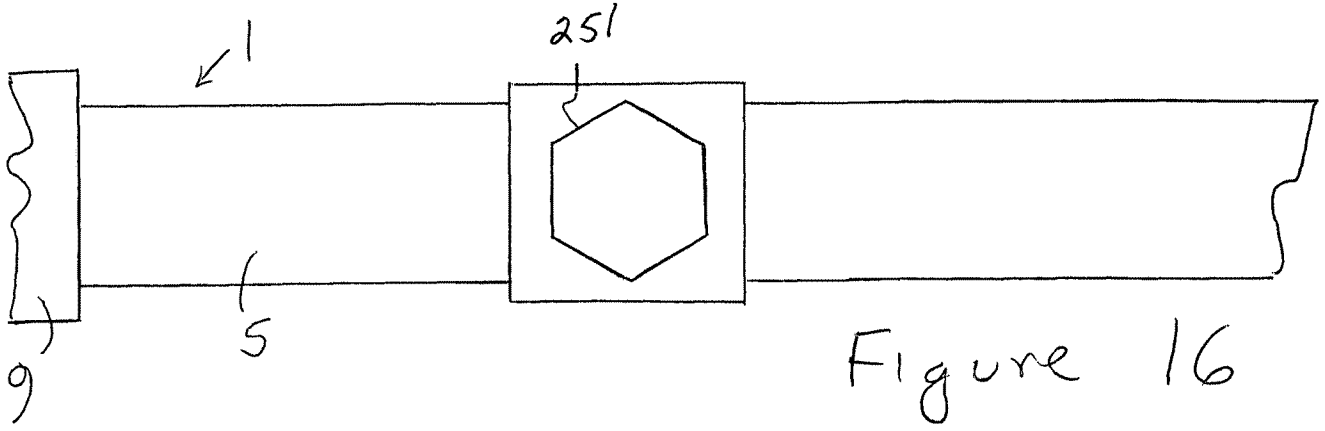
FIG. 16 is a cut side view of another alternative embodiment present invention handle having a utilities key wrench thereon; and, FIG. 17 is a cut side view of another alternative embodiment present invention device with a handle attachment receiver having a hydrant wrench thereon.
Figure 17:
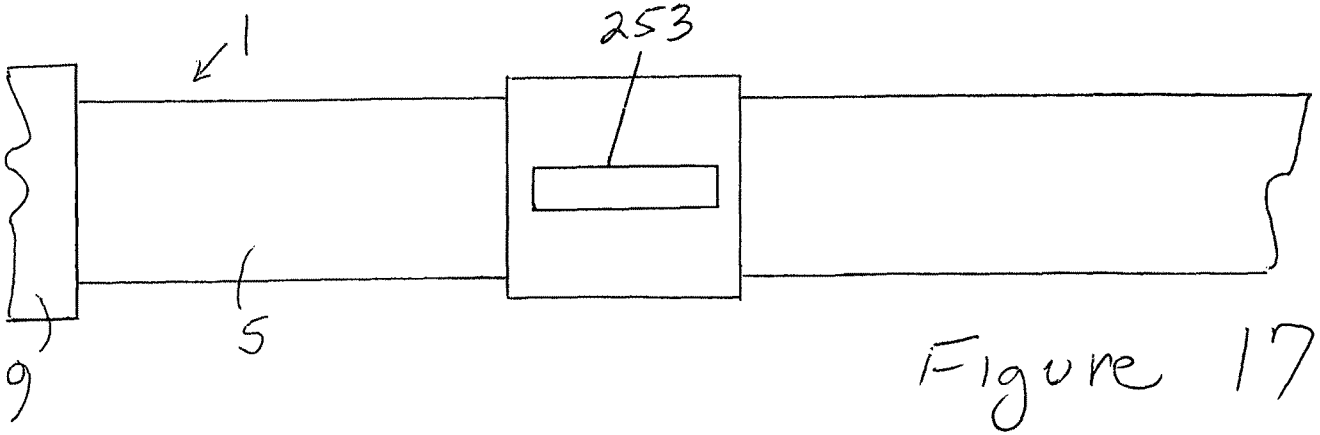

FIG. 16 is a cut side view of the present invention device 1 handle 5, with handle receiver 9, taken from FIG. 1. Here, the handle 5 has a utilities key wrench block 251 attached to it. Likewise, FIG. 17 is a cut side view of the FIG. 1 present invention device 1 with handle 5, handle attachment receiver 9. In this Figure, handle 5 has a hydrant wrench block 253 attached to it.

It should be noted that the pry claws shown in the appended drawings function together to make an extremely wide claw width that is superb for prying open doors and gates, ripping windows, and many other uses as said forth above. In addition, the central spike claw that may be positioned in a lock keyhole or shackle that will pierce and shatter the lock when the present invention device is struck at its top. Additionally, the flat pry claws have tapered edges for various penetration and leverage actions. Further, when inverted, the present invention device becomes a driving device and sledgehammer. As can be seen in all of the Figures shown, the ram region of each claw head has a top of a predetermined width and has a bottom that has a predetermined width that is at least 30% wider than the top predetermined width.

Although the present invention multifunctional tactical devices may be hand carried, alternatively, one or two straps be attached thereto for shoulder or over the shoulder transport purposes. Preferred are straps with quick-release mechanisms and/or velcro-type attachments.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A multifunctional dynamic entry device for fire, police, military and other tactical invasive and protective actions, which device comprises:

a) a claw head having a ram region and a claw region, said ram region having a top of a predetermined width and a bottom that has a predetermined width that is at least 30% wider than said top predetermined width, said claw head having a front with a flat ram area at said ram region, and having a back with a handle attachment means, said claw region having a plurality of claws extending downwardly from said bottom of said ram region, said plurality of claws includes at least three claws with two outer claws and at least one central claw;

b) an elongated handle member having a proximal end and a distal end and being connected to said claw head handle attachment means at said distal end;

c) said plurality of claws including at least two claws having a tapered space therebetween for placement under objects for pull and lift actions;

d) said plurality of claws tapering downwardly from said flat ram area;

e) said plurality of claws having a total external width of at least three inches;

f) said two outer claws being flat pry bar claws having sharpened ends like an ax and said at least one central claw being a tapered shackle busting spike claw, so that said claw region has three tines;

g) each of said flat pry bar claws including a tapered cutting edge; and h) one of said claw head and said handle being a hydrant wrench, and the other of said claw head and said handle being a utilities key wrench.

2. The multifunctional dynamic entry device for fire, police, military and other tactical invasive and protective actions of claim 1 wherein said ram region has a front view shape of the top and sides of a trapezoid.

3. A multifunctional dynamic entry device for fire, police, military and other tactical invasive and protective actions, which device comprises:

a) a claw head having a ram region and a claw region, said ram region having a top of a predetermined width and a bottom that has a predetermined width that is at least 30% wider than said top predetermined width, said claw head having a front with a flat ram area at said ram region, and having a back with a handle attachment means, said handle attachment means including at least one protrusion extending from said claw head back for attachment of an elongated handle, said claw region having a plurality of claws extending downwardly from said bottom of said ram region, said plurality of claws includes at least three claws with two outer claws and at least one central claw;

b) an elongated handle member having a proximal end and a distal end and being connected to said claw head handle attachment means at said distal end;

c) said plurality of claws including at least two claws having a tapered space therebetween for placement under objects for pull and lift actions;

d) said plurality of claws tapering downwardly from said flat ram area;

e) said plurality of claws having a total external width of at least three inches;

f) said two outer claws being flat pry bar claws having sharpened ends like an ax and said at least one central claw being a tapered shackle busting spike claw, so that said claw region has three tines;

g) each of said flat pry bar claws including a tapered cutting edge; and h) one of said claw head and said handle being a hydrant wrench, and the other of said claw head and said handle being a utilities key wrench.

4. The multifunctional dynamic entry device for fire, police, military and other tactical invasive and protective actions of claim 3 wherein said ram region has a front view shape of the top and sides of a trapezoid.

* * * * *